US005730523A

United States Patent [19]

Flood

[11] Patent Number: 5,730,523

[45] Date of Patent: Mar. 24, 1998

[54] PORTABLE CONCRETE PLANT

[76] Inventor: Jeffrey D. Flood, 1100 Legion St., Shakopee, Minn. 55379

[21] Appl. No.: 691,470

[22] Filed: Aug. 2, 1996

[51] Int. Cl.[6] ..... B28C 5/18; B28C 5/42

[52] U.S. Cl. ..... 366/18; 366/33; 366/37; 366/53; 366/54

[58] Field of Search ..... 366/16, 18, 20, 366/27, 29, 33, 35, 37, 41, 53, 54, 43, 61; 406/92; 220/410

[56] References Cited

U.S. PATENT DOCUMENTS

| | | | |
|---|---|---|---|
| 2,269,561 | 1/1942 | Strayer | 366/35 |
| 3,151,849 | 10/1964 | Maxon, Jr. | 366/41 |
| 3,415,498 | 12/1968 | Zaccaron | 366/37 |
| 3,502,306 | 3/1970 | Beardsley | 366/41 |
| 4,189,237 | 2/1980 | Bake | 366/54 |
| 4,406,548 | 9/1983 | Haws . | |
| 4,586,824 | 5/1986 | Haws . | |
| 4,624,575 | 11/1986 | Lantz | 366/20 |
| 4,792,234 | 12/1988 | Doherty | 366/27 |
| 4,922,463 | 5/1990 | Del Zotto . | |
| 5,044,819 | 9/1991 | Kilheffer et al. | 366/18 |
| 5,486,047 | 1/1996 | Zimmerman . | |
| 5,605,397 | 2/1997 | Oberg et al. | 366/35 |

FOREIGN PATENT DOCUMENTS

| | | | |
|---|---|---|---|
| 973539 | 8/1975 | Canada | 366/37 |
| 2408444 | 7/1979 | France | 366/33 |
| 4138716 | 5/1993 | Germany | 366/54 |
| 2236260 | 4/1991 | United Kingdom | 366/20 |

*Primary Examiner*—Tony G. Soohoo

*Attorney, Agent, or Firm*—Palmatier, Sjoquist, Helget & Voigt, P.A.

[57] ABSTRACT

A portable concrete plant that can be transported on a single vehicle to a construction site consists of a transporting vehicle, a rotating drum for mixing the concrete, containers for sand and crushed rock, a scale for weighing a mixture of sand and crushed rock, a conveyor for conveying the mixture of sand and crushed rock to the rotating drum, a container for portland cement, a conveyor for conveying the portland cement to the rotating drum, a source of water, and a concrete pump for dispensing the concrete from the rotating drum. A fly ash container and a second scale for weighing fly ash may also be on the vehicle. The entire apparatus may be controlled by a computer which controls the various containers and scales so as to vary the proportions of sand, crushed rock, fly ash, portland cement, and water in the rotating drum to produce concrete of varying strength. The entire apparatus has dimensions which meet the length, width and height requirements for vehicles moving on the highways.

40 Claims, 1 Drawing Sheet

PORTABLE CONCRETE PLANT

BACKGROUND OF THE INVENTION

Concrete is made by mixing sand, crushed, rock, portland cement, and water in varying proportions to produce concrete of varying structural strength. Particulate matter such as fly ash may also be mixed with the other ingredients.

Concrete is normally mixed centrally at large concrete plants and then transported to the job site by concrete trucks with rotating drums which keep the concrete from hardening. However, it may take several truckloads of concrete to complete a large construction job. Running concrete trucks back and forth between the central concrete plant and the job site is expensive in terms of fuel costs, driver wages, wear and tear on the trucks, and environmental impact such as air pollution from the truck engines.

Furthermore, economies of scale dictate that a central concrete plant must produce large amounts of concrete of a given composition before switching to a different composition. Once a batch of a given composition has been ordered, there is little flexibility to change the composition for another purpose in a given job.

When road restrictions are in place in cold climates such as Minnesota during the Spring months, heavy concrete trucks are not permitted to travel over access roads. This puts a heavy burden on a builder to get the trucks into the site before the road restrictions go into effect, or risk having to delay the job until the road restrictions are lifted.

Concrete has a "flash point" which occurs about thirty minutes after mixing at which the concrete has maximum strength. The strength of concrete is rated assuming that the concrete is poured before the flash point. In most cases, however, it is impossible to pour the concrete before its flash point using a central concrete plant and concrete trucks, because the job site is farther away from the concrete plant than can be reached by truck within 30 minutes. The strength of concrete decreases up to 15% at one hour after mixing.

Standard concrete trucks also have the disadvantage that the truck must get right up to the pour site before dispensing its load, because there is no pump on the truck which can be used to pump the concrete. Therefore, when a construction site is muddy, as is often the case, it may be difficult for a concrete truck to get to the pour site.

Portable concrete plants exist but they are generally large, unwieldy structures which can not be transported easily from site to site on a single vehicle. These past portable concrete plants have generally not included a rotating drum such as found on concrete trucks, so that concrete trucks are necessary for transporting the concrete from the portable concrete plant to the job site.

There is a need for a portable concrete plant which addresses the above deficiencies.

SUMMARY OF THE INVENTION

A portable concrete plant that can be transported on a single vehicle to a construction site consists of a transporting vehicle, a rotating drum for mixing the concrete, containers for sand and crushed rock, a scale for weighing a mixture of sand and crushed rock, a conveyor for conveying the mixture of sand and crushed rock to the rotating drum, a container for portland cement, a conveyor for conveying the portland cement to the rotating drum, a source of water, and a concrete pump for dispensing the concrete from the rotating drum. A fly ash container and a second scale for weighing fly ash may also be on the vehicle. The entire apparatus may be controlled by a computer which controls the various containers and scales so as to vary the proportions of sand, crushed rock, fly ash, portland cement, and water in the rotating drum to produce concrete of varying strength. The entire apparatus has dimensions which meet the length, width and height requirements for vehicles moving on the highways.

A principal object and advantage of the present invention is that it provides a portable concrete plant that may be transported to the job site on a single vehicle.

Another object and advantage of the present invention is that it saves energy and money by avoiding the necessity for running concrete trucks between a central concrete plant and the job site, and also has less impact on the environment.

Another object and advantage of the present invention is that the unmixed components of concrete have less weight than mixed concrete, so that the invention may be transported to the job site even when road restrictions are in effect.

Another object and advantage of the present invention is that it allows concrete to be poured within 30 minutes of being mixed, that is before the "flash point" is reached, and thereby allows the concrete to have maximum strength.

Another object and advantage of the present invention is that the proportions of sand, crushed rock, fly ash, portland cement and water may be varied at the job site to produce concrete of varying strength depending on the requirements at the job site.

Another object and advantage of the present invention is that includes a concrete pump which allows the vehicle to be up to 500 feet laterally or 1400 feet vertically away from the pour site, so that concrete may be delivered to inaccessible locations.

Another object and advantage of the present invention is that it includes a computer that controls the proportions of sand, crushed rock, fly ash, portland cement, and water in the concrete. The computer may be pre-programmed with several different mixes. Furthermore, the computer may have a printer which prints an invoice showing the exact quantities of the components which were used to make the concrete and which the buyer may use to audit the job. The invoice may also be shown to state inspectors to prove that the concrete has a given target structural strength. The computer may also have a modem with a cellular telephone which allows the invention to be centrally controlled and monitored.

DETAILED DESCRIPTION OF THE PREFERRED EMBODIMENTS

Figures 1, 2:
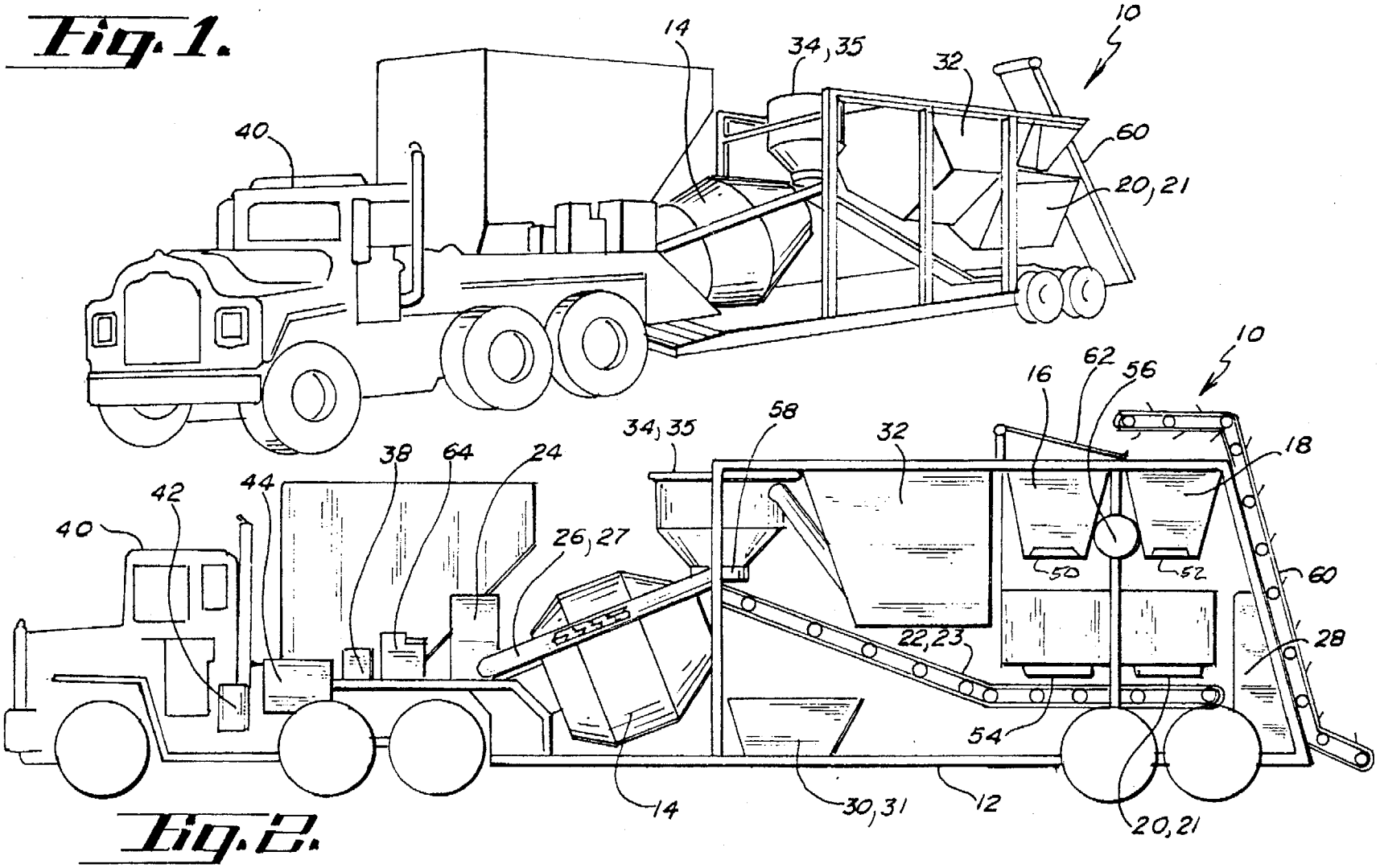
FIG. 1 is a perspective view of the portable concrete plant of the present invention.
FIG. 2 is a side elevational view of the portable concrete plant of the present invention.

The portable concrete plant of the present invention is shown generally in the Figures as reference numeral 10.

The portable concrete plant 10 has a vehicle 12 for transporting the apparatus, such as a flatbed trailer. All of the components of the plant 10 are mounted on the vehicle 12 so that the plant 10 can be transported as a unit.

Mounted on the vehicle 12 is a rotating drum 14 for mixing the concrete. The rotating drum 14 is powered by a hydraulic pump, as will be further discussed below.

A sand container 16 is mounted on the vehicle 12 and is filled with sand before the vehicle departs for the job site. A crushed rock container 18 is also mounted on the vehicle 12 and is filled with crushed rock before the vehicle departs for the job site.

Mounted on the vehicle 12, preferably below the sand container 16 and the crushed rock container 18 is a first weighing means 20 for weighing a mixture of sand and crushed rock. The first weighing means 20 receives sand from the sand container 16 and crushed rock from the crushed rock container 18. Preferably, the first weighing means 20 is a first scale 21.

A first conveying means 22 is mounted on the vehicle 12, preferably below the first weighing means 20 or first scale 21 for conveying a mixture of sand and crushed rock from the first weighing means 20 or first scale 21 to the rotating drum 14. Preferably the first conveying means 22 is a first conveyor 23.

A portland cement container 24 is also mounted on the vehicle 12 and contains portland cement for mixing in the rotating drum 14. A second conveying means 26 conveys portland cement from the portland cement container 24 to the rotating drum 14. Preferably, the second conveying means 26 is a first auger 27.

A source of water is also connected to the rotating drum. This may simply be a water tap at the job site. Preferably, however, a water tank 28 is mounted on the vehicle 12 so that water is available even at job sites without plumbing. The water tank 28 is connected to the rotating drum 14 by piping (not shown).

To dispense the mixed concrete from the rotating drum 14, a dispensing means 30 is mounted on the vehicle 12. Preferably, the dispensing means 30 is a concrete pump 31. Alternatively, a chute could be used as is used on concrete trucks.

A fly ash container 32 may also be mounted on the vehicle 12. A second weighing means 34 for weighing fly ash is also mounted on the vehicle 12. A third conveying means 36 for conveying fly ash from the fly ash container 32 to the second weighing means 34 is also provided. Preferably, the second weighing means 34 is a second scale 35 and the third conveying means 36 is a second auger 37.

A computer 38 is preferably mounted on the vehicle 12. The computer 38 controls the sand container 16, crushed rock container 18, first weighing means 20, portland cement container 24, second weighing means 34, fly ash container 32, and source of water or water tank 28 so as to vary the proportions of sand, crushed rock, fly ash, portland cement, and water in the rotating drum 14 to produce concrete of varying strength, as will be further discussed below.

A suitable computer is the Model "A" Batch Controller from Barron Intergrated Systems, Barron, Wis. 54812.

Preferably, a printer (not shown) is connected to the computer 38 for printing out a receipt showing the proportions of sand, crushed rock, fly ash, portland cement, and water in the rotating drum 14.

A tractor 40 is preferably attached to the vehicle 12 for moving the vehicle 12. The tractor has a transmission (not shown) which has been modified to supply power to a hydraulic pump (not shown) adapted to rotate the rotating drum 14, and to the concrete pump 31.

The sand container 16 has a first door 50 adapted to open the sand container to transfer sand to the first weighing means 20. The crushed rock container 18 has a second door 52 adapted to open the crushed rock container 18 and transfer crushed rock to the first weighing means 20. Preferably, the transfer takes place under the influence of gravity. The first weighing means 20 has a third door 54 to open the first weighing means 20 and transfer sand and crushed rock to the first conveying means 22. Again, preferably the transfer takes place under the influence of gravity.

The second weighing means 34 has a fourth door 58 adapted to open the second weighing means 34 and transfer fly ash to the rotating drum 14. Preferably, the transfer takes place under the influence of gravity.

All of the first door 50, second door 52, third door 54, and fourth door 58 are preferably air-operated by a compressed air source mounted on the vehicle and connected to the doors. Preferably, the compressed air source is a compressed air tank 56. Alternatively, any other source of compressed air such as a compressor at the job site could be used. The doors could also be operated mechanically by cabling, by hydraulics, or electrically.

Preferably, the first weighing means 20 transmits a first signal corresponding to the weight of sand and crushed rock in the first weighing means 20 to the computer 38 and the computer 38 operates the third door 54 based on the first signal so as to move sand and rock from the first weighing means 20 to the first conveying means 22 when the first signal reaches a predetermined value.

Preferably, the second weighing means 34 transmits a second signal corresponding to the weight of fly ash in the second weighing means 34 to the computer 38 and the computer 38 operates the fourth door 58 based on the second signal so as to move fly ash from the second weighing means 34 to the rotating drum 14 when the second signal reaches a predetermined value.

In order to meet state limits on the size of vehicles allowed to travel on the highways, the maximum width of the apparatus 10 is 8.5 feet, the maximum height is 13.5 feet, and the maximum length is 75 feet.

The apparatus 10 should be capable of dispensing 1 cubic yard per minuted providing necessary materials are continuously restocked.

For loading the sand container 16 and the crushed rock container 18, the apparatus 10 may also include a sand and rock conveyor 60. The apparatus may also include a diverter 62 adapted to switch the sand and rock conveyor 60 between the sand container 16 and the crushed rock container 18.

The apparatus may also include a generator 64 for powering the conveyors. The generator 64 is preferably mounted on the tractor 40.

In order to control the operation of the apparatus 10 from a central location, the computer 38 may have an attached modem (not shown) and cellular phone (not shown).

Loading and operation of the apparatus 10 will now be described.

If the optional sand and rock conveyor 60 is attached to the apparatus, an operator will first set the diverter 62 so that the sand and rock conveyor 60 empties into the sand container 16. The operator then loads sand onto the sand and rock conveyor 60, which delivers the sand to the sand container 16. The operator then switches the diverter 62 so that the sand and rock conveyor 60 empties into the crushed rock container 18. The operator then loads crushed rock onto the sand and rock conveyor 60, which delivers the rock to the crushed rock container 18.

Alternatively, sand and crushed rock may be loaded into the apparatus by any appropriate means such as a crane or power shovel.

Fly ash is optionally loaded into the optional fly ash container 32 by any appropriate means such as a crane or power shovel.

Portland cement is loaded into the portland cement container 24 by any appropriate means.

Water may be loaded into the water tank 28 at the central site, or a separate source of water at the job site may be used.

The apparatus 10 is then driven to the job site, where the concrete is mixed as follows.

The computer 38 controls the sand container 16 and crushed rock container 18 to deliver sand and crushed rock to the first weighing means 20 by opening the doors 509 and 52. When a signal from the first weighing means 20 indicates that the correct weight of sand and crushed rock is present in the first weighing means 20, the computer 38 opens the third door 54, allowing the sand and crushed rock to drop onto the first conveyor 22. The first conveyor 22 then carries the sand and crushed rock to the rotating drum 14.

Optionally, the computer 38 controls the fly ash container 32 to deliver fly ash to the second weighing means 34 until the second weighing means signals the computer 38 that the correct weight of fly ash is present in the second weighing means 34. The computer 38 then opens the fourth door 58, allowing fly ash to drop into the rotating drum 14.

The computer 38 then controls the portland cement container 24 to deliver the correct amount of portland cement to the rotating drum 14.

The computer 38 then controls the water tank 28 to deliver tile correct amount of water to the rotating drum 14.

The rotating drum 14 is driven to rotate by the hydraulic pump 44. After the correct mixing time, concrete is dispensed out of the rotating drum 14 to the dispensing means 30 or concrete pump 31 for delivery to the pouring location. If the concrete pump 31 is used, this pouring location may be a maximum of 600 feet laterally or 150 feet vertically from the apparatus 10.

After the concrete is dispensed, the operator may order the computer 38 to print out on the printer a receipt showing the proportions of sand, crushed rock, fly ash, portland cement, and water that were used to make the concrete.

By dialling up the computer 38 through the modem, a manager at a central site may control the computer 38 and set up the proportions of sand, crushed rock, portland cement, fly ash, and water to be used. The manager may also monitor the status of the apparatus 10 through the modem and computer 38. If, for example, past invoices have not been paid, the operator may order the computer 38 to prevent any more concrete from being mixed.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A transportable apparatus for producing concrete from sand, crushed rock, and portland cement, comprising:

(a) a vehicle for transporting the apparatus, (b) a rotating drum, (c) a sand container, (d) a crushed rock container, (e) first weighing means for weighing a mixture of sand and crushed rock, the first weighing means receiving sand from the sand container and crushed rock from the crushed rock container, (f) first conveying means for conveying a mixture of sand and crushed rock from the first weighing means to the rotating drum, (g) a portland cement container, (h) second conveying means for conveying portland cement from the portland cement container to the rotating drum, (i) a source of water connected to the rotating drum, and (j) dispensing means for dispensing concrete from the rotating drum; the rotating drum, sand container, crushed rock container, first conveying means, first weighing means, portland cement container, second conveying means, and dispensing means all being mounted on the vehicle.

2. The apparatus of claim 1, further comprising:

(k) a fly ash container, (l) second weighing means for weighing fly ash, and (m) third conveying means for conveying fly ash from the fly ash container to the second weighing means.

3. The apparatus of claim 2, further comprising a computer for controlling the sand container, crushed rock container, first weighing means, portland cement container, second weighing means, fly ash container and source of water so as to vary the proportions of sand, crushed rock, fly ash, portland cement, and water in the rotating drum to produce concrete of varying strength.

4. The apparatus of claim 3, further comprising a printer connected to the computer for printing out a receipt showing the proportions of sand, crushed rock, fly ash, portland cement, and water in the rotating drum.

5. The apparatus of claim 1, further comprising a tractor connected to the vehicle and a transmission connected to the tractor, the transmission supplying power to a hydraulic pump adapted to rotate the rotating drum, and to the dispensing means.

6. The apparatus of claim 1, wherein the sand container has a first door and the crushed rock container has a second door, the first door and second door adapted to open the sand container and crushed rock container respectively and transfer sand and crushed rock to the first weighing means, and the first weighing means has a third door to open the first weighing means and transfer sand and crushed rock to the first conveying means.

7. The apparatus of claim 6, wherein the first weighing means transmits a first signal corresponding to the weight of sand and crushed rock in the first weighing means to the computer and wherein the computer operates the third door based on the first signal so as to move sand and crushed rock from the first weighing means to the first conveying means when the first signal reaches a predetermined value.

8. The apparatus of claim 7, wherein the second weighing means has a fourth door adapted to open the second weighing means and transfer fly ash to the rotating drum.

9. The apparatus of claim 8, wherein the second weighing means transmits a second signal corresponding to the weight of fly ash in the second weighing means to the computer and wherein the computer operates the fourth door based on the second signal so as to move fly ash from the second weighing means to the rotating drum when the second signal reaches a predetermined value.

10. The apparatus of claim 1, wherein the dispensing means is a concrete pump.

11. The apparatus of claim 1, wherein the maximum width of the apparatus is 8.5 feet, the maximum height of the apparatus is 13.5 feet, and the maximum length of the apparatus is 75 feet, thereby meeting federal limits on the size of vehicles moving on the highways.

12. The apparatus of claim 1, wherein the dispensing means is capable of dispensing 1 cubic yard of concrete per minute.

13. The apparatus of claim 3, further comprising a modem connected to the computer and a cellular phone connected to the modem so as to allow the computer to be remotely controlled.

14. The apparatus of claim 1, further comprising a sand and rock conveyor for loading sand and crushed rock into the first container and crushed rock container, respectively.

15. The apparatus of claim 14, further comprising a diverter adapted to switch the sand and rock conveyor between the sand container and the crushed rock container.

16. The apparatus of claim 2, wherein the second conveying means and third conveying means are augers.

17. The apparatus of claim 6, wherein the first door, second door, and third door are air-operated and further comprising a source of compressed air mounted on the vehicle and connected to the first door, second door, and third door.

18. The apparatus of claim 1, wherein the source of water is a water tank mounted on the vehicle.

19. A transportable apparatus for producing concrete from sand, crushed rock, and portland cement, comprising:

(a) a vehicle for transporting the apparatus, (b) a rotating drum, (c) a sand container, (d) a crushed rock container, (e) a sand and rock conveyor, adapted to convey sand to the sand container and crushed rock to the crushed rock container, (f) a diverter, adapted to switch the first conveyor between the sand container and the crushed rock container, (g) first weighing means for weighing a mixture of sand and crushed rock, the first weighing means receiving sand from the sand container and crushed rock from the crushed rock container, (h) a first conveyor mounted on the vehicle, adapted to convey a weighed mixture of sand and crushed rock from the first weighing means to the rotating drum, (i) a portland cement container, (j) a first auger for moving portland cement from the portland cement container to the rotating drum, (k) a water container connected to the rotating drum by piping, and (l) dispensing means for dispensing concrete from the rotating drum; the rotating drum, sand container, crushed rock container, sand and rock conveyor, diverter, first weighing means, first conveyor, portland cement container, first auger, water container, piping, and means for dispensing concrete all being mounted on the vehicle.

20. The apparatus of claim 19, further comprising:

(m) a fly ash container, (n) second weighing means for weighing fly ash, the second weighing means emptying into the rotating drum, and (o) a second auger for moving fly ash from the fly ash container to the second weighing means.

21. The apparatus of claim 20, further comprising a computer for controlling the actions of the first weighing means, second weighing means, portland cement container, and water container so as to vary the proportions of sand, crushed rock, fly ash, portland cement, and water in the rotating drum to produce concrete of varying strength.

22. The apparatus of claim 21, further comprising a printer connected to the computer for priming out a receipt showing the proportions of sand, crushed rock, portland cement, and water in the rotating drum.

23. The apparatus of claim 19, further comprising an electric generator supplying power to the first conveyor and sand and rock conveyor.

24. The apparatus of claim 23, further comprising a tractor connected to the vehicle and a transmission connected to the tractor, the transmission supplying power to the generator, to a hydraulic pump adapted to rotate the rotating drum, and to the dispensing means.

25. The apparatus of claim 24, wherein the sand container has a first air door and the crushed rock container has a second air door, the first air door and second air door adapted to open the sand container and crushed rock container respectively and transfer sand and crushed rock to the first weighing means, and the first weighing means has a third air door to open the first weighing means and transfer sand and crushed rock to the first conveyor, and further comprising a compressed air tank adapted to operate the air doors and an air compressor mounted on the tractor and connected to the compressed air tank.

26. The apparatus of claim 25, wherein the first weighing means transmits a first signal corresponding to the weight of sand and crushed rock in the first weighing means to the computer and wherein the computer operates the third air door based on the first signal so as to move sand and crushed rock from the first weighing means to the first conveyor when the first signal reaches a predetermined value.

27. The apparatus of claim 25, wherein the second weighing means has a fourth air door adapted to open the second weighing means and transfer fly ash to the rotating drum, the fourth air door being operated by the air tank.

28. The apparatus of claim 27, wherein the second weighing means transmits a second signal corresponding to the weight of fly ash in the second weighing means to the computer and wherein the computer operates the fourth air door based on the second signal so as to move fly ash from the second weighing means to the rotating drum when the second signal reaches a predetermined value.

29. The apparatus of claim 19, wherein the dispensing means is a concrete pump.

30. The apparatus of claim 19, wherein the maximum width of the apparatus is 8.5 feet, the maximum height of the apparatus is 13.5 feet, and the maximum length of the apparatus is 75 feet, thereby meeting limits on the size of vehicles moving on the highways.

31. The apparatus of claim 19, wherein the dispensing means is capable of dispensing 1 cubic yard of concrete per minute.

32. The apparatus of claim 21, further comprising a modem connected to the computer and a cellular phone connected to the modem so as to allow the computer to be remotely controlled.

33. A transportable apparatus for producing concrete from sand, crushed rock, and portland cement, comprising:

(a) a vehicle for transporting the apparatus, (b) a rotating drum, (c) a sand container, (d) a crushed rock container, (e) a sand and rock conveyor, adapted to convey sand to the sand container and crushed rock to the crushed rock container, and further comprising a diverter for switching the sand and rock conveyor between the sand container and the crushed rock container, (f) a first scale for weighing a mixture of sand and crushed rock, the first scale receiving sand from the sand container and crushed rock from the crushed rock container, (g) a first conveyor for conveying a mixture of sand and crushed rock from the first scale to the rotating drum, (h) a portland cement container, (i) a first auger for moving portland cement from the portland cement container to the rotating drum, (j) a water container connected to the rotating drum by piping, (k) an electric generator supplying power to the first convey or and sand and rock conveyor, (l) a concrete pump for dispensing concrete from the rotating drum, (m) a tractor connected to the vehicle and a transmission connected to the tractor, the transmission supplying power to the generator, to a hydraulic pump adapted to rotate the rotating drum, and to the concrete pump, and (n) a computer for controlling the first scale, portland cement container and water container so as to vary the proportions of sand, crushed rock, portland cement, and water in the rotating drum to produce concrete of varying strength, a printer connected to the computer for printing out a receipt showing the proportions of sand, crushed rock, portland cement, and water in the rotating drum, and a modem connected to the computer and a cellular phone connected to the modem so as to allow the computer to be remotely controlled, the rotating drum, sand container, crushed rock container, sand and rock conveyor, first scale, first conveyor, first auger, portland cement container, water container, electric generator, concrete pump, and computer all being mounted on the vehicle.

34. The apparatus of claim 33, further comprising:

(o) a fly ash container, (p) a second scale for weighing fly ash, the second scale emptying into the rotating drum, and (q) a second auger for moving fly ash from the fly ash container to the second scale.

35. The apparatus of claim 34, wherein the sand container has a first air door and the crushed rock container has a second air door, the first air door and second air door adapted to open the sand container and crushed rock container respectively and transfer sand and crushed rock to the first scale, and the first scale has a third air door to open the first scale and transfer sand and crushed rock to the first conveyor, and further comprising a compressed air tank adapted to operate the air doors and an air compressor mounted on the tractor and connected to the compressed air tank.

36. The apparatus of claim 35, wherein the first scale transmits a first signal corresponding to the weight of sand and crushed rock in the first scale to the computer and wherein the computer operates the third air door based on the first signal so as to move sand and crushed rock from the first scale to the first conveyor when the first signal reaches a predetermined value.

37. The apparatus of claim 36, wherein the second scale has a fourth air door adapted to open the second scale and transfer fly ash to the rotating drum, the fourth air door being operated by the air tank.

38. The apparatus of claim 37, wherein the second scale transmits a second signal corresponding to the weight of fly ash in the second scale to the computer and wherein the computer operates the fourth air door based on the second signal so as to move fly ash from the second scale to the rotating drum when the second signal reaches a predetermined value.

39. The apparatus of claim 33, wherein the maximum width of the apparatus is 8.5 feet, the maximum height of the apparatus is 13.5 feet, and the maximum length of the apparatus is 75 feet, thereby meeting limits on the size of vehicles moving on the highways.

40. The apparatus of claim 33, wherein the dispensing means is capable of dispensing 1 cubic yard of concrete per minute.

* * * * *